United States Patent [19]

Whitney

[11] Patent Number: 4,841,616

[45] Date of Patent: Jun. 27, 1989

[54] HELICALLY WOUND ELBOW CONDUIT AND METHOD OF FABRICATING SAME

[75] Inventor: Daniel E. Whitney, Arlington, Mass.

[73] Assignee: The Charles Stark Draper Laboratory, Inc., Cambridge, Mass.

[21] Appl. No.: 81,109

[22] Filed: Aug. 3, 1987

[51] Int. Cl.[4] ..... B21C 37/06

[52] U.S. Cl. ..... 29/157 A; 29/428; 72/368; 138/154

[58] Field of Search ..... 72/368, 49; 29/428, 29/157 A, 157 T; 138/154

[56] References Cited

U.S. PATENT DOCUMENTS 2,171,195 8/1939 Sonesson ..... 29/428

FOREIGN PATENT DOCUMENTS 42172 1/1967 Japan ..... 29/157 A

*Primary Examiner*—Joseph M. Gorski

*Attorney, Agent, or Firm*—Joseph S. Iandiorio

[57] ABSTRACT

A method of fabricating elbow conduit including constructing a conduit development having a set of sequential segments, each segment having a lateral axis parallel to corresponding lateral axes of the other segments and a longitudinal axis skewed at least in part with respect to the lateral axis and having the same orientation as the corresponding longitudinal axes of the other segments in the set. The segments are joined end-to-end and the dimensions of the joined segments are transferred to a continuous length of material to generate a continuous blank havng periodically varying opposing boundaries. At least one outer alignment mark is defined on each segments of the blank to establish an outer ridge line on the outside circumference of the elbow and at least one inner alignment mark is defined on each segment to establish an inner ridge line on the inner circumference of the elbow. The method further includes helically winding the continuous blank to align the inner and outer alignment marks and join the abutting boundaries to form an elbow conduit. Helically wound elbow conduits formed from a continuous blank having curvilinear or rectilinear opposing boundaries are also disclosed.

21 Claims, 6 Drawing Sheets

HELICALLY WOUND ELBOW CONDUIT AND METHOD OF FABRICATING SAME

FIELD OF INVENTION

This invention relates to the formation of elbow conduit from a continuous blank and more particularly to the construction of such a blank having periodically varying opposing boundaries.

BACKGROUND OF INVENTION

Virtually all ventilation ducts require one or more elbow bends to maneuver around obstacles or join ducts extending at different angles. Curved ducts are especially important on ships where duct diameter, angle and shape often change every few feet. The ventilation ducts are typically installed last and must be maneuvered around and through existing structures. Further, since regulations do not allow soft-sided, flexible ducts, each change in the duct diameter, angle or shape must be accomplished with rigid material which is carefully measured and cut to establish the proper change.

One of the most common methods of elbow formation involves the layout of the elbow as individual segments each having a longitudinal axis and a lateral axis normal to each other. The layout, hereinafter referred to as a development, establishes the dimensions of each segment which is individually cut from a blank. The separate segments, known as clam shells, are joined together by crimping or welding. This method is labor-intensive and slow.

A common method for forming straight duct of circular cross section is to wind it helically from a continuous blank having straight boundaries, that is, edges. No elbows are formed when the blank has straight boundaries.

Heiman, in U.S. Pat. No. 4,287,742, describes an apparatus which manufactures a curved conduit by helically winding it from a continuous blank whose edges have been cut in a particular pattern. However, as disclosed, e.g., in Column 8, the opposing boundaries of the blank simply differ in phase by 180 degrees: when such a blank is helically wound a conduit with double curvature results. That is, the apparatus as disclosed is capable only of manufacturing a twisted conduit having an arcuate axis that does not lie in a single plane. Such a twisted conduit is rarely used in the industry, and a method of altering the shape of the blank to form an elbow having a single curvature is not disclosed.

SUMMARY OF INVENTION

It is therefore an object of this invention to provide an improved method of fabricating elbow conduit for use as ventilation ducts and in other applications.

It is a further object of this invention to provide such a method which manufactures an elbow conduit as a single unit.

It is a further object of this invention to provide such elbow conduit which requires fewer welds.

It is a further object of this invention to provide such elbow conduit which is inexpensive to manufacture.

A still further object of this invention is to provide such elbow conduit which can be manufactured using numerical control.

It is a further object of this invention to provide an improved method of fabricating elbow conduit as well as straight conduit which can be fully automated.

Yet another object of this invention is to provide such a method which can easily fabricate individually shaped ducts for custom applications.

This invention results from the realization that a truly effective, fully automated method of forming an elbow duct as a single unit can be achieved by altering the dimensions of the separate segments of a conventional development by skewing the longitudinal axis relative to the lateral axis and joining the segments end to end to generate a continuous blank having periodically varying opposing boundaries, and defining on the blank outer and inner alignment marks which, when aligned during winding, establish outer and inner ridge lines of the elbow duct.

This invention features a method of fabricating helically wound elbow conduit including constructing a conduit development having a set of sequential segments, each segment having opposing boundaries, a lateral axis parallel to corresponding lateral axes of the other segments, and a longitudinal axis skewed at least in part with respect to the lateral axis and having the same orientation as the corresponding longitudinal axes of the other segments. The method further includes joining these segments end-to-end and transferring the dimensions of the joined segments to a continuous length of material to generate a continuous blank having periodically varying opposing boundaries. The method also includes defining on each segment of the blank at least one outer alignment mark for establishing an outer ridge line on the outside circumference of the elbow conduit to be fabricated and defining on each segment at least one inner alignment mark for establishing an inner ridge line on the inner circumference of the elbow conduit, and helically winding the continuous blank to align the inner and outer alignment marks and join the abutting boundaries to form the elbow conduit. This invention also features the elbow conduit formed by this method.

In one embodiment, the segments of the set are constructed to have curvilinear opposing boundaries, the skewed longitudinal axes are parallel and colinear, and each opposing boundary is defined by the combination of a cosine function and a linear function which describes the corresponding skewed longitudinal axis Alternatively, the segments are constructed to have rectilinear opposing boundaries, and two outer ridge lines are defined on the outside circumference of the elbow and two inner ridge lines are defined on the inside circumference of the elbow. The segments of the set are constructed to have a plurality of panels and the outer and inner ridge lines are edges of the panels.

In another embodiment, the periodically varying opposing boundaries of the continuous blank are identical and shifted in phase with respect to each other. The opposing boundaries may differ in phase by an amount other than 180 degrees, the segments of the set may be identical, and additional segments may be constructed having opposing boundaries with a different periodicity such as segments constructed to form straight conduit as part of the elbow conduit.

In yet another embodiment, the method further includes forming an initial conduit development of an initial elbow conduit. The initial conduit development has a plurality of initial sequential segments, each initial segment having non-skewed axes and initial opposing boundaries. The longitudinal axis for each initial segment is normal to the lateral axis, and the initial opposing boundaries are curvilinear. Each opposing boundary of each final segment is then constructed by combining a first function for the respective initial curvilinear boundary and a second function Alternatively, the initial opposing boundaries are rectilinear, each initial segment being formed of a plurality of initial panels. Further, constructing the final conduit development for the continuous blank includes shifting at least some of the edges of one or more of the initial panels to skew the longitudinal axis for those panels.

This invention also features a helically wound elbow conduit comprising a continuous blank which forms the elbow conduit. The continuous blank has periodically varying opposing boundaries which establish between them alternating narrow and wide portions. The continuous blank has an outer ridge line established by alignment marks on the wide portions, and an inner ridge line established by alignment marks on the narrow portions. The opposing boundaries may be curvilinear or rectilinear.

DISCLOSURE OF PREFERRED EMBODIMENT

Other objects, features and advantages will occur from the following description of a preferred embodiment and the accompanying drawings, in which.

This invention may be accomplished by fabricating elbow conduit by constructing a development including a set of sequential segments such that each segment has a lateral axis parallel to corresponding lateral axes of the other segments and a longitudinal axis skewed at least in part with respect to the lateral axis and parallel with the longitudinal axes of the other segments of the set. The construction of the development can include alteration of a conventional development to obtain skewed longitudinal axes. Each segment is conceptually joined end-to-end to form a continuous blank having periodically varying opposing boundaries. At least one outer alignment mark is defined on each segment for establishing an outer ridge line on the outside circumference of the elbow and at least one inner alignment mark is defined for establishing an inner ridge line on the inner circumference of the elbow. The continuous blank is helically wound to align the inner and outer alignment marks and to join the abutting boundaries to form the elbow conduit.

Figure 1A:
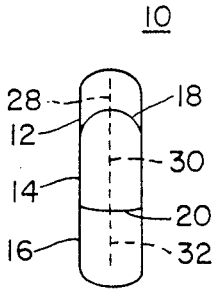
FIGS. 1A–1C are schematic back, side and front elevational views, respectively, of a conventional elbow duct.
Figure 1B:
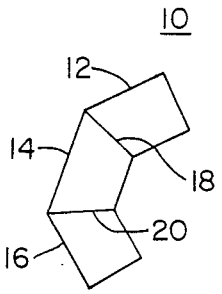
Fig. 1B PRIOR ART
Figure 1C:
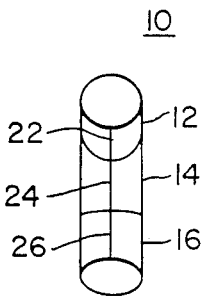

Conventional elbow duct 10 is shown in FIGS. 1A–1C having individual duct segments 12, 14, 16 which are joined by crimping or welding. Segments 12, 14, 16 must be joined along seams 18, 20 and in addition must be joined to themselves along seams 22, 24 and 26.

Figure 1D:
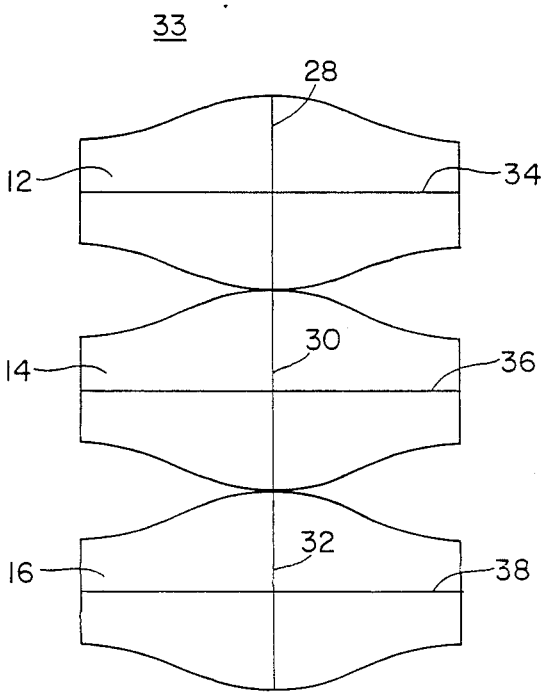
Fig. 1D PRIOR ART
FIG. 1D is a schematic top plan view of a conventional development for the elbow duct of FIGS. 1A–1C.

Development 33, FIG. 1D, is a conventional layout of segments 12, 14, 16. Lateral axes 28, 30 and 32 lie along the outer ridge of elbow conduit 10, FIG. 1A, and are perpendicular to longitudinal axes 34, 36 and 38.

Figure 2:
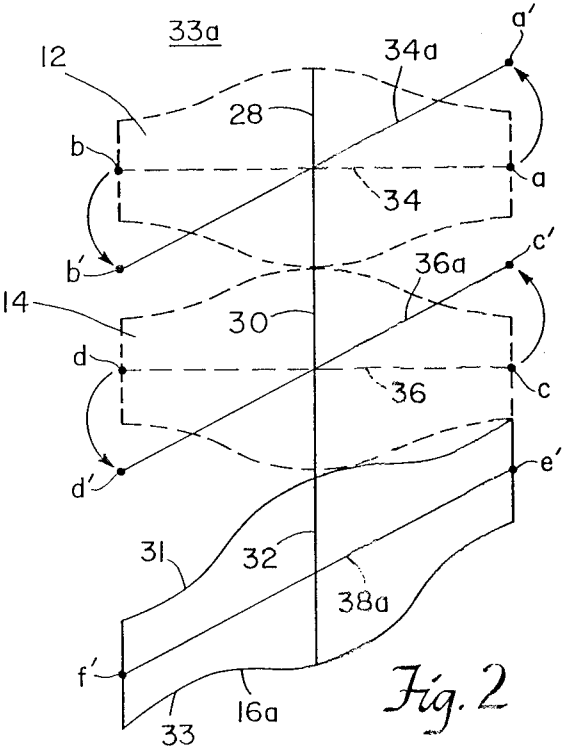
FIG. 2 illustrates the conventional development of FIG. 1D with one portion skewed according to this invention.

Curved, helically wound elbow ducts with circular cross section according to the present invention are constructed by altering several dimensions of conventional duct development 33. The conventional development serves as an initial development, shown in phantom, as the upper two segments 12 and 14 of development **33*a*, FIG. 2. Segment 16*a*, FIG. 2, is shown after being skewed according to this invention. Longitudinal axes 34, 36 and 38 are skewed relative to their respective lateral axes and are reoriented as illustrated by axes 34*a*, 36*a* and 38*a*. Point a of longitudinal axis 34 is lifted to point a′ while point b is lowered to point b′ . Similarly, points c and d of longitudinal axis 36 are rearranged to define the new orientation of skewed longitudinal axis 36*a***. In this construction the new longitudinal axes lie halfway between the initial points, e.g., point c′ is halfway between points c and a.

The opposing boundaries of each segment are redefined by combining the original cosine function describing each initial boundary with a second function which defines the new longitudinal axis for that segment. Opposing boundaries 31, 33 of skewed segment **16*a* are defined about longitudinal axis 38*a*** as described in more detail below.

Figure 3:
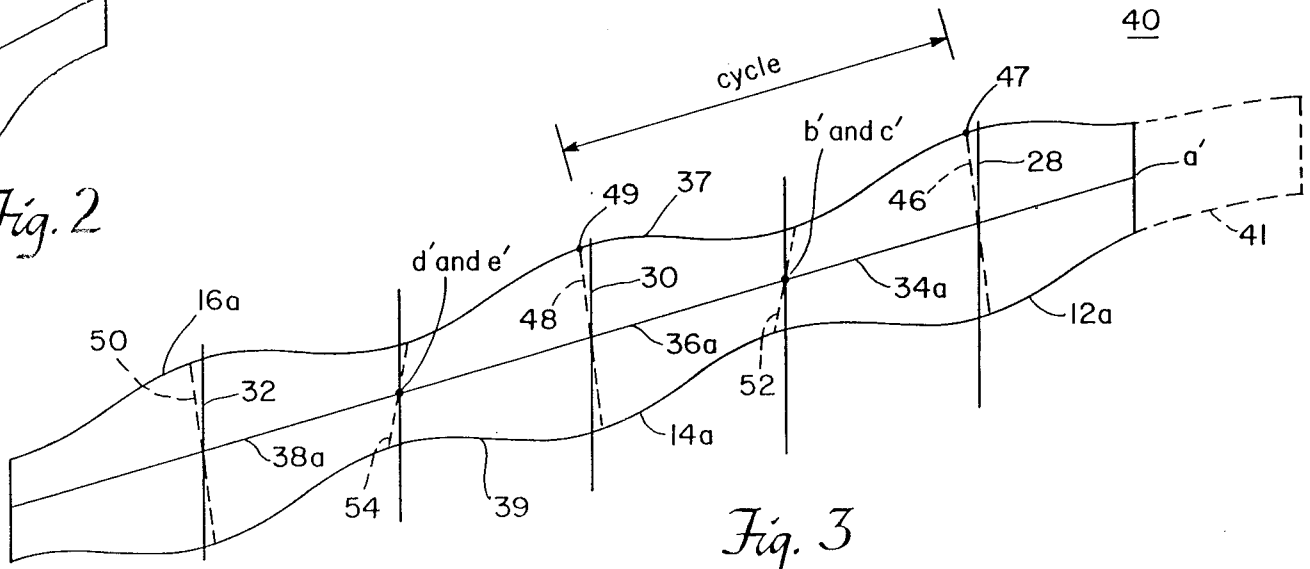
FIG. 3 is a schematic top plan view of several skewed segments according to FIG. 2 joined end to end to form a continuous blank.

Continuous blank 40, FIG. 3, can be formed into helically wound conduit according to this invention and is defined by conceptually joining the altered segments of FIG. 2 end-to-end such that point b′ of segment **12*a* corresponds with point c′ of segment 14*a*, and by aligning longitudinal axes 34*a*, 36*a* to be parallel and colinear with each other. Similarly, point e′ of segment 16*a* is aligned with point d′ of segment 14*a*. Lateral axes 28, 30, 32** remain parallel to each other. A larger or smaller number of altered segments may be joined in this fashion to form an elbow of more or less extent, respectively.

Joining segments **12*a*, 14*a*, 16*l* establishes opposing boundaries 37, 39 which are identical and periodically varying but shifted in phase with respect to each other. The difference in phase is established according to the type of curvature desired for the elbow conduit to be formed. To construct elbow conduit 42, FIGS. 4A–4C, which has a central axis lying in a single plane, periodically varying opposing boundaries 37, 39 typically have a difference in phase of about 160 degrees which can be observed when one boundary is conceptually superimposed having straight, non-periodically varying opposing boundaries can be added to form an integral straight portion for elbow conduit 42**.

Figure 4C:
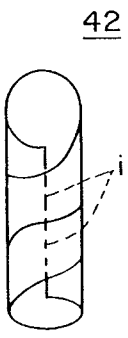
FIGS. 4A–4C are back, side and front elevational views, respectively, of a helically wound elbow duct according to this invention made from the blank of FIG. 3.
Figure 4B:
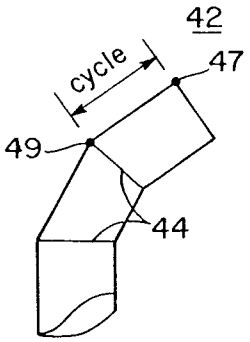
Figure 4A:
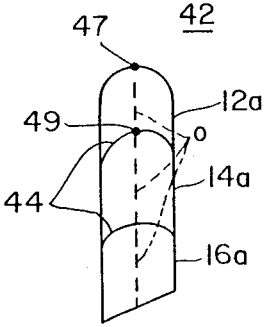

Alignment marks must be established on continuous blank 40 before it is wound to form elbow conduit 42. Alignment lines 52 and 54 are aligned to form inner ridge i, FIG. 4C, and alignment lines 46, 48, 50 are defined to establish outer ridge o, shown in FIG. 4A. For example, points 47 and 49, defined by the intersection of alignment lines 46, 48 with boundary 37, lie along outer ridge o and define between them one cycle or period of elbow conduit 42. One cycle corresponds to the length of each of the initial segments 12, 14, 16 which were altered to construct the dimensions of continuous blank 40. In this construction each wrap, that is, each complete revolution, of blank 40 corresponds to one cycle; alternate arrangements may be used such as one-half or two wraps per original cycle. For ease of joining it is desirable to have as short a seam as possible; as shown in FIG. 4C, inner ridge i is simply a line defined by alignment lines 52, 54, rather than by actual seams such as seams 22, 24, 26 of FIG. 1C. Elbow 42 thus has fewer joints and therefore requires less joining than conventional elbows.

Figure 6:
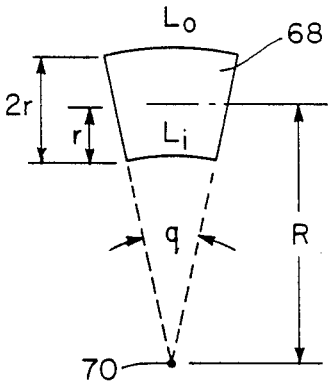
FIG. 6 is a schematic elevational view of one section of the conduit of FIG. 5.
Figure 5:
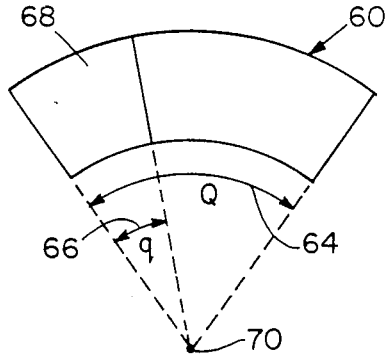
FIG. 5 is a schematic elevational view of a length of elbow conduit.

One technique according to this invention for constructing helically wound elbow duct is as follows. Elbow 60, FIG. 5, has a total included angle Q represented by arrow 64 between the dashed lines intersecting at point 70. The total number N of segments within the total elbow included angle is selected, and the segment included angle q, represented by arrow 66, is determined by the formula $$q=Q/N \tag{1}$$

to define each segment such as segment 68. Segment 68 has an outer length $L_o$, FIG. 6. The length of the inner ridge line of segment 68 is represented by length $L_i$.

Two other parameters of segment 68 are defined by the dimensions of the initial, conventional elbow conduit. Segment 68 has a half-height of r and a distance R from its center line to imaginary point 70. $L_i$ and $L_o$ are then defined as follows:

$$L_i=2(R-r)\tan(q/2) \tag{2}$$

and $$L_o=Li\,((R+r)/(R-r)) \tag{3}$$

Figure 7A:
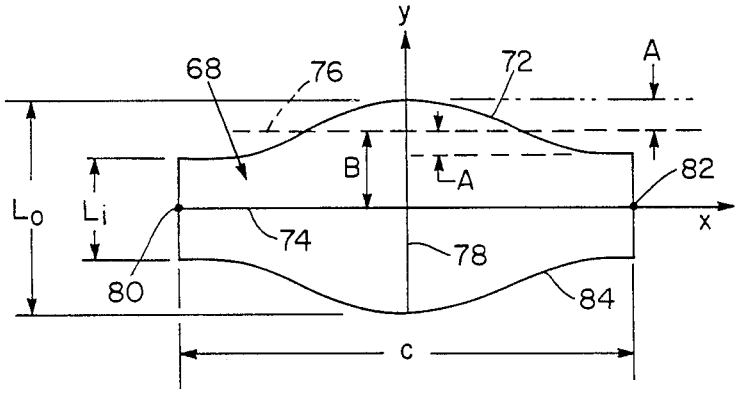
FIGS. 7A–7C are schematic diagrams of the alteration of a development according to this invention to skew the longitudinal axis of each segment.

The bounds of boundary 72, FIG. 7A, are then defined by determining distance B from longitudinal axis 74 to dashed line 76 midway between the upper and lower points of boundary 72. Distance B is defined by the equation $$B=(L_o+L_i)/4 \tag{4}$$

The distance between the upper and lower points of boundary 72 and dashed line 76 is represented by distance A which is defined by the formula:

$$A=(L_o-L_i)/4 \tag{5}$$

Longitudinal axis 74 is designated as the x axis and lateral axis 78 is designated as the y axis. The circumference c of segment 68 is established by defining left and right limits 80, 82 at a distance of $\pm\pi r$ from x=0. Finally, the equation defining upper boundary 72 and lower boundary 84, represented by $y_1$ and $y_2$, respectively, are defined as $$y_1=B+A\cos x/r \tag{6}$$

where x is equal to or greater than $-\pi r$ and less than or equal to $\pi r$, and $$y_2=-y_1. \tag{7}$$

Figure 7B:
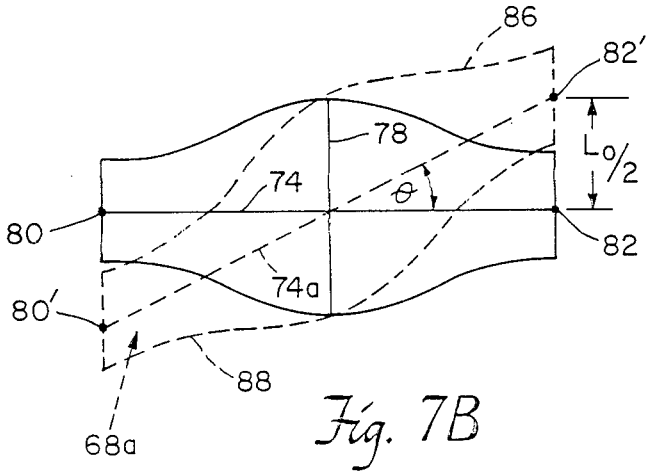

Having defined the dimensions of segment 68, the opposing boundaries are reoriented by skewing longitudinal axis 74 as longitudinal axis **74*a*, FIG. 7B. Point 82 is lifted to point 82' by a distance of one-half $L_o$ to skew lateral axis 74*a* by angle $\theta$. Similarly, point 80 is lowered to point 80'**.

Longitudinal axis **74*a*** is thus defined by the linear function $$y_{axis}=\beta x \tag{8}$$

where $$\beta=(L_o/2)/\pi r \tag{9}$$

Opposing boundaries 86, 88 are generated using the formula $$y_{boundary}=y_{original}+y_{axis} \tag{10}$$

where $y_1$ and $y_2$ are substituted for $y_{original}$.

Similar segments are joined end to end as shown in FIG. 3.

Once the opposing boundaries are defined, the equations can be used to automatically define and cut a continuous blank from a continuous length of material based on numerical control.

Figure 7C:
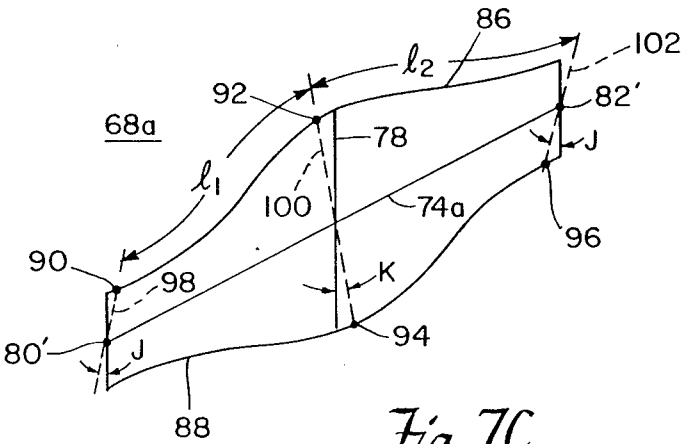

Alignment marks such as points 90, 92, 94, 96, FIG. 7C, are established to render boundary lengths $1_1$ and $1_2$ equal by adjusting alignment lines 98, 100, 102. Angles J and K are maintained equal to each other while adjusting lines 98, 100, 102. When segment **68*a* is helically wound, alignment point 90 touches alignment point 96. Dashed line 100 represents the outer ridge line while dashed lines 98, 102** represent the inner ridge line of the helically wound elbow.

As is true of elbows made from conventional segments, the exact dimensions of the final helically wound elbow can vary depending on the amount of material used to join its edges as a seam. The seam can be established by conventional crimping, or arc or seam welding. Further, one or more ribs can be formed onto the blank to increase its bursting and collapsing strength. Extra material can be added to the development along the boundaries 86, 88 to provide for crimping or ribs, as is done when making conventional ductwork.

Figure 9:
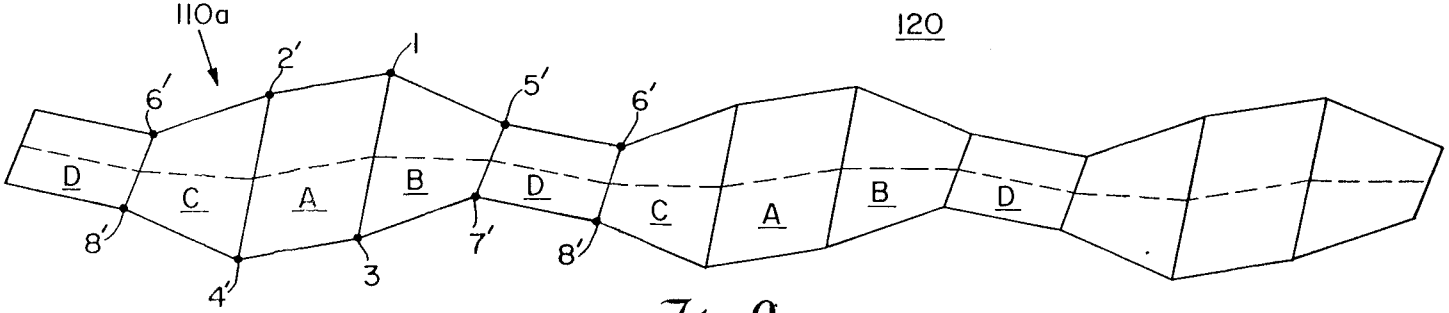
FIG. 9 is the continuous rectilinear blank formed from the altered segment shown in FIG. 8.
Figure 8:
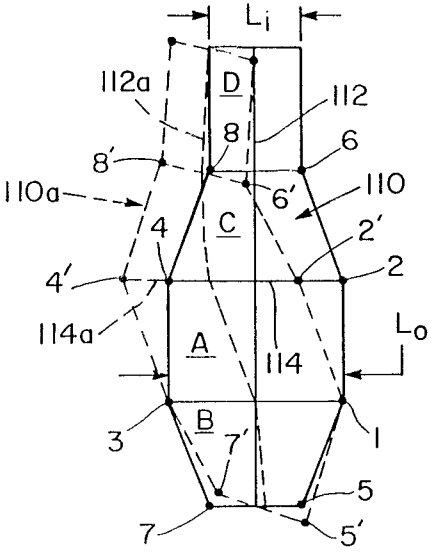
FIG. 8 is a schematic diagram of the alteration of a rectilinear development according to this invention.

Helically wound elbow conduits with rectangular cross section according to this invention can also be constructed to have rectilinear periodically varying opposing boundaries. Conventional segment 110, FIG. 8, has longitudinal axis 112 passing through inner panel D, side panels C and B, and outer panel A. Lateral axis 114 lies along an edge of outer panel A. Altered segment **110*a* according to this invention exhibits longitudinal axis 112*a* skewed relative to lateral axis 114*a*. As described below, points 2 and 4 of conventional segment 110 are shifted in one direction as points 2', 4', points 1 and 3 remain in place for both segments 110 and 110a and points 5, 7, and 6, 8 are relocated as points 5', 7', and 6', 8', respectively. Segment 110***a* is shown joined end-to-end with other segments as continuous blank 120, FIG. 9, having rectilinear opposing boundaries. When helically wound, like letters are matched with like so that the outer circumference of the elbow conduit formed from blank 120 is formed from panels A, the inner circumference of the conduit is formed from panels D, and one side is formed from panels B while the other side is formed from panels C.

Figure 10A:
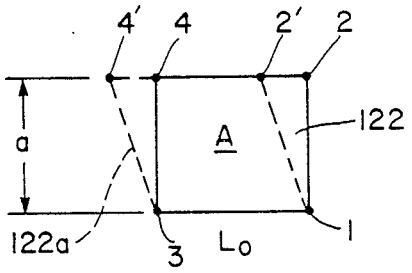
FIGS. 10A–10C are schematic diagrams of construction of the top, side and bottom panels, respectively, for the blank of FIG. 9.
Figure 10B:
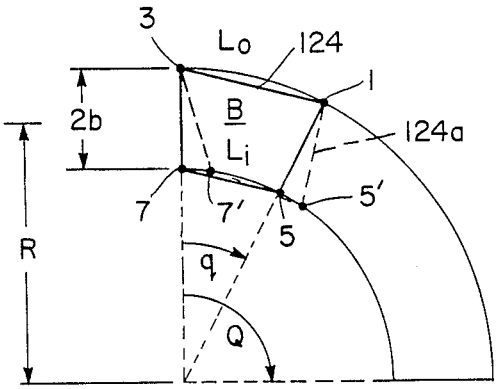
Figure 10C:
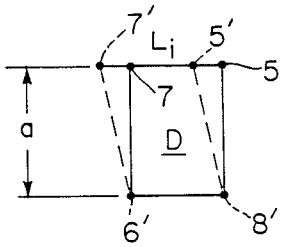

One technique of constructing segment 110a is shown in FIGS. 10A–10C. Outer panel A has a width a and a length $L_o$ of one cycle. Conventional panel 122 is altered to become panel 122*a* by advancing points 2 and 4 twenty-five percent of one cycle to points 2' and 4', retaining their original separation.

The height of the duct is determined by half-height b. Equations (1)–(3) are applied by substituting b for r in side panel B, represented by side panel 124, points 5 and 7 are regressed 25 percent of one cycle to points 5' and 7', retaining their original separation, to generate altered panel 124*a*. Panel C is the mirror image of panel B. Inner panel D, having inner length $L_i$ and width a, connects corresponding points on panels B and C.

Figure 12:
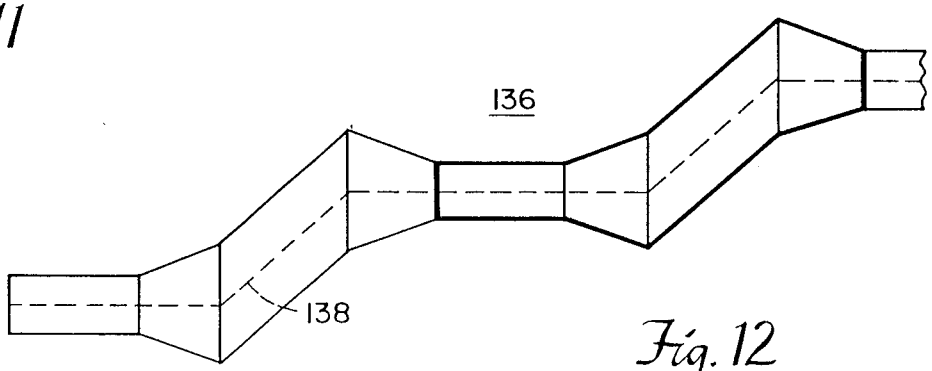
FIG. 12 is a blank made from the segments as shown in FIG. 11.
Figure 11:
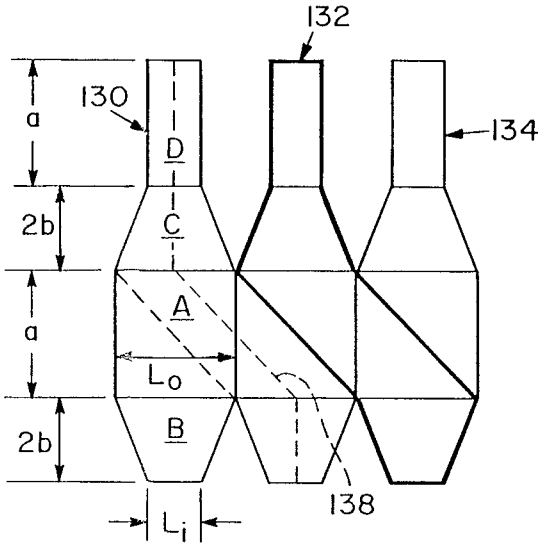
FIG. 11 is a schematic diagram of an alternative method of constructing a helically wound rectilinear duct.

An alternate method of forming helically wound rectilinear duct is shown in FIGS. 11 and 12. Inner panels D and side panels B and C of conventional segments 130, 132 and 134 are left unaltered while some of the edges of outer panel A are redirected by one cycle. The segments are laid end to end to form blank 136, FIG. 12, which has a longitudinal axis 138 for each segment that is oriented the same as corresponding longitudinal axes. When helically wound, a bend is made in the blank at each location at which a bend was made in the initial segments. A similar procedure (not shown) comprises shifting inner panel D one cycle while leaving outer panel A and side panels B and C the same as in the conventional duct.

Figure 13:
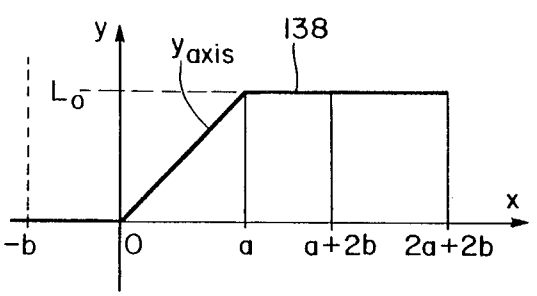
FIG. 13 is a schematic representation of the longitudinal axis shown in FIGS. 11 and 12.

Another method for creating the rectilinear boundary is analogous to that used for forming curvilinear duct. By analogy to equation (10), one forms the original boundary $Y_{original}$ and forms a function $Y_{axis}$ that is used in equation (10) to skew the original boundary. Longitudinal axis 138, FIG. 11, is shown separately in FIG. 13 and can be generated by the following function:

$$Y_{axis} = \begin{cases} o & \text{for } -2b \leqq x \leqq o \\ L_o x/a & \text{for } o \leqq x \leqq a \\ L_o & \text{for } a \leqq x \leqq 2(a+b) \end{cases}$$

Although specific features of the invention are shown in some drawings and not others, this is for convenience only as each feature may be combined with any or all of the other features in accordance with the invention.

Other embodiments will occur to those skilled in the art and are within the following claims:

What is claimed is:

1. A method of fabricating helically wound elbow conduit comprising:

constructing a conduit development including a set of sequential segments, each segment having opposing boundaries, a lateral axis parallel to corresponding lateral axes of the other segments, and a longitudinal axis oblique at least in part with respect to the lateral axis and having the same orientation as corresponding longitudinal axes of the other segments in the set; said longitudinal axis being defined as an axis which bisects each segment into identical parts;

joining the segments end to end and transferring the dimensions of the joined segments to a continuous length of material thereby generating a continuous blank having periodically varying opposing boundaries which differ in phase from each other relative to said longitudinal axis by an amount other than 180 degrees;

defining on each segment of the blank at least one outer alignment mark for establishing an outer ridge line on an outside circumference of the elbow conduit to be fabricated, and defining on each segment at least one inner alignment mark for establishing an inner ridge line on an inner circumference of the elbow conduit to be fabricated; and helically winding said continuous blank, thereby aligning the inner alignment marks with each other and the outer alignment marks with each other; abutting the opposing boundaries against each other; and joining the abutting boundaries to each other.

2. The method of claim 1 in which the segments of the set have curvilinear opposing boundaries and oblique longitudinal axes which are continuous when assembled to form said continuous blank.

3. The method of claim 2 including defining each opposing boundary by the combination of a cosine function and a linear function describing the corresponding oblique longitudinal axis.

4. The method of claim 3 including defining said boundaries by the same cosine function which differs in sign for every other said boundary.

5. The method of claim 1 in which the segments of the set have rectilinear opposing boundaries.

6. The method of claim 5 including defining two outer ridge lines on each segment for the outside circumference of the elbow conduit to be fabricated, and two inner ridge lines on each segment for the inside circumference of the elbow conduit to be fabricated.

7. The method of claim 6 in which the segments of the set have a plurality of panels and the outer and inner ridge lines are edges of the panels.

8. The method of claim 1 in which the periodically varying opposing boundaries of the continuous blank are substantially identical.

9. The method of claim 1 in which the segments of the set are identical.

10. The method of claim 1 including constructing additional segments having opposing boundaries with a different periodicity.

11. The method of claim 10 in which the additional segments form straight conduit as part of the elbow conduit.

12. The method of claim 1 further including forming an initial conduit development of an initial elbow conduit, the initial conduit development having a plurality of initial sequential segments, each initial segment having non-oblique axes and initial opposing boundaries.

13. The method of claim 12 in which the longitudinal axis of each initial segment is normal to the lateral axis of each initial segment.

14. The method of claim 12 in which the initial opposing boundaries are curvilinear and each opposing boundary of each sequential segment is constructed by combining a first function for the respective initial curvilinear boundary and a second function representing the oblique longitudinal axis.

15. The method of claim 12 in which the initial opposing boundaries for each initial segment are rectilinear, each initial segment is formed of a plurality of initial panels, and constructing the conduit development for the continuous blank includes shifting to least one of the edges of at least one of the initial panels to make oblique the longitudinal axis for that panel.

16. A method of fabricating helically wound elbow conduit comprising:

forming an initial conduit development of an initial elbow conduit to be fabricated having initial sequential segments, each initial segment having non-oblique axes and initial opposing boundaries which are curvilinear;

constructing from the initial development a final conduit development including a set of final sequential segments, each final segment having a lateral axis parallel to corresponding lateral axes of the other final segments and a longitudinal axis oblique at least in part with respect to the lateral axis and parallel with the corresponding longitudinal axes of the other final segments in the set; said longitudinal axis being defined as an axis which bisects each segment into identical parts; each opposing boundary of each final segment being constructed by combining a first function for the respective initial curvilinear boundary and a second function representing the oblique longitudinal axis for that final segment;

joining the segments end to end and transferring the dimensions of the joined segments to a continuous length of material thereby generating a continuous blank having periodically varying opposing curvilinear boundaries which differ in phase from each other relative to said longitudinal axis by an amount other than 180 degrees;

defining on each segment of the blank at least one outer alignment mark for establishing an outer ridge line on an outside circumference of the elbow conduit to be fabricated and defining on each final segment at least one inner alignment mark for establishing an inner ridge line on an inner circumference of the elbow conduit to be fabricated;

helically winding said continuous blank thereby aligning the inner marks with each other and the outer alignment marks with each other; abutting the opposing boundaries against each other; and joining the abutting boundaries to each other.

17. A method of fabricating helically wound elbow conduit comprising:

forming an initial conduit development of an initial elbow conduit to be fabricated having initial sequential segments, each initial segment having non-oblique axes and initial opposing boundaries which are rectilinear;

constructing from the initial development a final conduit development including a set of final sequential segments, each final segment having a lateral axis parallel to corresponding lateral axes of the other final segments and a longitudinal axis oblique at least in part with respect to the lateral axis and parallel with the corresponding longitudinal axes of the other final segments in the set, each opposing boundary of each final segment being constructed by combining a first function for the respective initial rectilinear boundary and a second function representing the oblique longitudinal axis for that final segment; said longitudinal axis being defined as an axis which bisects each segment into identical parts;

joining the segments end to end and transferring the dimensions of the joined segments to a continuous length of material thereby generating a continuous blank having periodically varying opposing rectilinear boundaries which differ in phase from each other relative to said longitudinal axis by an amount other than 180 degrees;

defining on each segment of the blank at least one outer alignment mark for establishing an outer ridge line on an outside circumference of the elbow conduit to be fabricated and defining on each final segment at least one inner alignment mark for establishing an inner ridge line on an inner circumference of the elbow conduit to be fabricated; and helically winding said continuous blank thereby aligning the inner alignment marks with each other and the outer alignment marks with each other; abutting the opposing boundaries against each other; and joining the abutting boundaries to each other.

18. A method of fabricating helically wound elbow conduit comprising:

forming an initial conduit development of an initial elbow conduit having initial sequential segments, each initial segment having non-oblique axes and initial opposing boundaries which are rectilinear, and each initial segment being formed of a plurality of initial panels;

constructing from the initial development a final conduit development including a set of final sequential segments, each final segment having a lateral axis parallel to corresponding lateral axes of the other final segments and a longitudinal axis oblique at least in part with respect to the lateral axis and having the same orientation as the corresponding longitudinal axes of the other final segments in the set, at least one edge of at least one panel being shifted to make oblique the longitudinal axis for that panel; said longitudinal axis being defined as an axis which bisects each segment into identical parts;

joining the segments end to end and transferring the dimensions of the joined segments to a continuous length of material thereby generating a continuous blank having periodically varying opposing rectilinear boundaries which differ in phase from each other relative to said longitudinal axis by an amount other than 180 degrees;

defining on each final segment of the blank at least one outer alignment mark for establishing an outer ridge line on the outside circumference of the elbow conduit to be fabricated and defining on each final segment at least one inner alignment mark for establishing an inner ridge line on the inner circumference of the elbow conduit;

helically winding said continuous blank thereby aligning the inner alignment marks with each other and the outer alignment marks with each other; abutting the opposing boundaries against each other; and joining the abutting boundaries to each other.

19. The method of claim 18 in which each initial segment includes an outer panel which lies on the outside circumference of the initial elbow conduit, and at least one edge of the outer panel is shifted to make oblique the longitudinal axis for that panel.

20. The method of claim 18 in which each initial segment includes an inner panel which lies on the inside circumference of the initial elbow conduit, and at least one edge of the inner panel is shifted to make oblique the longitudinal axis for that panel.

21. The method of claim 18 in which each initial segment includes a plurality of initial panels, and at least one edge of each panel is shifted to make oblique the longitudinal axis for that panel.

* * * * *